United States Patent [19]

Kuhn

[11] 4,107,974

[45] Aug. 22, 1978

[54] METHOD FOR STRAIGHTENING AUTOMOBILE BODIES

[76] Inventor: Charles J. Kuhn, 10520 Plainview Ave., Tujunga, Calif. 91042

[21] Appl. No.: 662,830

[22] Filed: Mar. 1, 1976

[51] Int. Cl.[2] ..... B21D 1/12

[52] U.S. Cl. ..... 72/457; 72/705

[58] Field of Search ..... 72/705, 457, 461; 294/82 R, 78 R; 24/116 B, 116 R, 230.5 CR, 230.5 TD

[56] References Cited

U.S. PATENT DOCUMENTS

| | | | |
|---|---|---|---|
| Re. 18,714 | 1/1933 | Wochner | 72/705 X |
| 1,785,923 | 12/1930 | Wade | 72/705 X |
| 2,140,686 | 12/1938 | Bennett | 72/705 X |
| 2,451,307 | 10/1948 | South | 72/705 |
| 2,770,484 | 11/1956 | Lunsford | 294/78 R X |
| 2,830,789 | 4/1958 | MacMillan | 72/705 X |
| 2,842,822 | 7/1958 | Bennett | 294/78 R X |
| 3,452,575 | 1/1969 | Williams et al. | 72/705 X |
| 3,518,867 | 7/1970 | Rouis | 72/705 X |
| 3,567,267 | 3/1971 | Lechner | 294/78 R |
| 3,727,966 | 4/1973 | Stockwell | 294/82 R |
| 3,760,625 | 9/1973 | Archambault | 72/705 X |
| 3,765,058 | 10/1973 | Scdoris | 24/230.5 R |

FOREIGN PATENT DOCUMENTS

| | | | |
|---|---|---|---|
| 1,008,976 | 11/1965 | United Kingdom | 294/82 R |

*Primary Examiner*—C.W. Lanham
*Assistant Examiner*—D. M. Gurley
*Attorney, Agent, or Firm*—Christie, Parker & Hale

[57] ABSTRACT

An anchoring device for use in straightening automobile bodies of unitized construction includes a hook comprising an elongated steel bar having a long, generally straight portion bent at one end to form a C-shaped portion for being releasably hooked around a means of attaching the leaf spring of the automobile suspension system to the automobile body. A chain is releasably attached to the straight portion of the hook, and in one method of using the hook the free end of the chain is affixed to the ground to anchor the rear of the automobile against a pulling force applied to the front of the automobile.

4 Claims, 9 Drawing Figures

A
A
3
3
32
38
40
42
44
46
50
52
54
56
58
59
60
62

METHOD FOR STRAIGHTENING AUTOMOBILE BODIES

BACKGROUND

This invention, in terms of apparatus, relates to an anchor for being releasably attached to an automobile to provide an anchor point or pulling point when straightening the frame or body of the automobile. In terms of method, the invention includes using the hook to straighten automobile bodies of unitized construction.

In the past, conventional body construction of American made automobiles generally has included a frame having a pair of spaced apart, longitudinally extending, parallel frame members, or rails, supporting opposite underside portions of the automobile body. Such frame members are part of a rigid framework which includes cross-members extending between the rails. The body of the automobile is rigidly affixed to this framework.

When repairing frame damage on such automobiles, a power-pull system typically is used in which one end of the automobile frame is anchored by a chain or cable extending from the frame to a tie-down point on the ground, and a pulling force is applied to the opposite end of the frame from a chain or cable engaged with a hydraulic pulley apparatus. It is a relatively simple matter to find secure points for attaching the ends of the chains or cables to the front and rear portions of the frame members when straightening the frame.

In recent years the energy shortage and resulting higher gasoline prices have resulted in greater use of compact automobiles in this country. A large number of these vehicles have bodies of so-called unitized construction in which the body is generally of integral construction and is not attached to a separate body-supporting framework such as that described above. The main structural portions of the unitized body include so-called sill panels, or rocker panels, which are hollow metal beams extending along opposite sides of the automobile body below the door panels.

When straightening a body of unitized construction, the present procedure is to attach a unitized body clamp to an anchor point or pulling point on the bottom side of the rocker panel. This area of the rocker panel has a pair of side-by-side elongated flanges which extend away from the underside of the rocker panels and are pinch-welded together along the length of the rocker panels. The unitized body clamp has opposite faces which are bolted together into contact with the opposite sides of the flanges below the rocker panel. The clamps have teeth which bite into the metal flanges when the clamps are bolted to provide a good grip for an anchor point or pulling point. In recent years the metal used in many unitized bodies, including the rocker panels, has no been strong enough to withstand tearing or other marring of the appearance of the automobile body when a pulling force of sufficient magnitude to straighten the body is applied via unitized body clamps attached to the flanged portions of the rocker panels.

SUMMARY

The present invention provides a method and apparatus for straightening an automobile body of unitized construction without requiring an anchor point or pulling point on the flanged portions of the rocker panels, or on any other points on the automobile body itself.

Thus, the invention avoids marring or other damage done to the body when the body is being straightened.

Briefly, one form of the invention includes an anchoring device which includes a hook made from a steel bar the major length of which has a thickness of at least about ⅝ inch. The major portion of the bar is elongated, and is bent at one end to form a generally C-shaped hook for being releasably attached to the rounded portion of the means for attaching an end of the leaf spring of the automobile suspension system to the body of the automobile. An elongated tension line is releasably attached to the elongated portion of the hook. The free end of the tension line is affixed either to a tie-down point or to a means for applying a pulling force to the automobile body.

Thus, when a pulling force is applied to an automobile body of unitized construction, it can be straightened without tearing or otherwise marring the body of the automobile itself. The attachment of the leaf spring to the automobile body is generally a double-welded point of high stength, and therefore provides an anchor point or pulling point which can withstand the pulling loads normally required to straighten automobile bodies of unitized construction. Thus, the body of the automobile is not marred during straightening, which reduces the time and cost of the repair work.

These and other aspects of the invention will be more fully understood by referring to the following detailed description and the accompany drawings.

DRAWINGS

DETAILED DESCRIPTION

Figure 1:
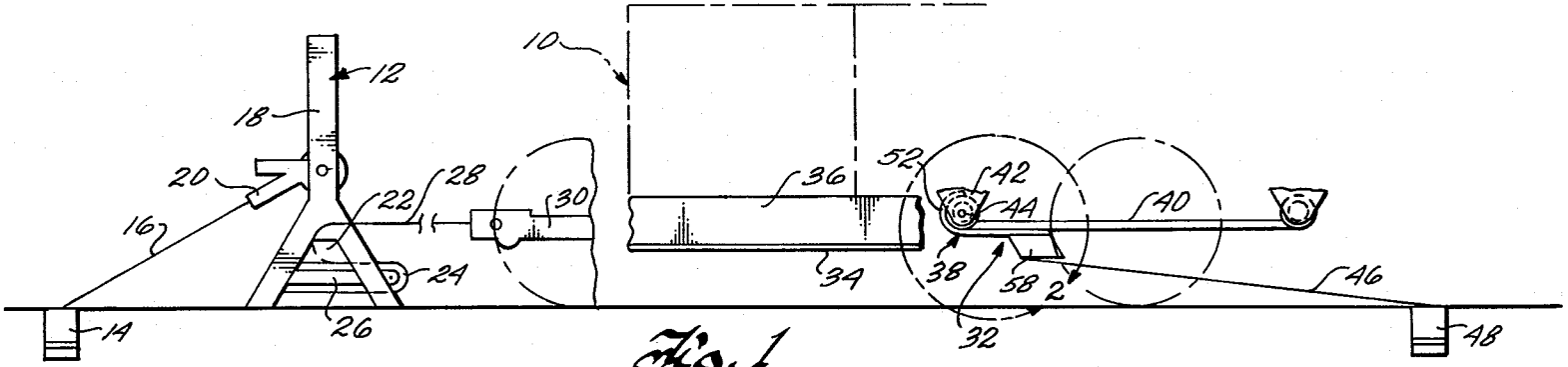
FIG. 1 is a fragmentary schematic side elevation view showing the anchor device of this invention and a presently preferred method of use.

Referring to FIG. 1, an automobile body 10 of unitized construction is straightened by the apparatus and method of this invention. The automobile body is straightened by a hydraulic pulley apparatus 12 which is anchored to a tie-down device 14 by means of a cable or chain 16. The hydraulic pulley apparatus 12 is conventional and can be the type of pull device disclosed in my U.S. Pat. No. 3,589,680. This device generally includes a pair of side-by-side upright, inverted Y-shaped frames 18, and an attachment device 20 between the frames 18 for holding one end of the anchor chain 16. The free end of the chain 16 is attached to the tie-down device 14 which can be of the type disclosed in my U.S. Pat. No. 3,494,587. The hydraulic pulley apparatus 12 also includes an essentially fixed pulley 22 near the apex of the Y, and a movable pulley 24 below pulley 22 and attached to a hydraulic ram 26. A flexible chain or cable 28 extends from an attachment device (not shown) on the frames 18 around the pulley 24 and the pulley 22 and then to a fixed point of attachment on the body of the automobile. The free end of the chain 28 typically is affixed to any of a number of fixed points of attachment on the front end of the automobile. The drawing illustrates a point of attachment to the cowling 30 of the automobile. In using the hydraulic pulley apparatus 12, the hydraulic cylinder 26 is pressurized to extend the piston of the ram 26 and move the pulley 24 to the right in FIG. 1 which, in effect, extends the length of the chain around the pulleys 22 and 24 and exerts a pulling force to the left in FIG. 1 on the cowling 30.

When a pulling force is applied to the front portion of the automobile 10, the rear of the automobile is anchored against the pulling force by an anchor assembly 32 according to this invention. As described above, the present method commonly used to anchor the rear portion of an automobile of unitized construction comprises attaching a clamp (not shown) to the flange 34 at the base of the rocker panel 36. To overcome the problems associated with this procedure, anchor assembly 32 of the present invention includes a hook 38 which is releasably attached to the front portion of the leaf spring 40 in the automobile's rear suspension system. A large number of automobiles of unitized construction include rear leaf springs such as the leaf spring 40. The front ends of such leaf springs typically are affixed to a mounting bracket or housing 42 which, in turn, is rigidly affixed to the underside of the automobile body. The bracket 42 holds a bushing 44 or the like to which the front end of the leaf spring is attached so the leaf spring may pivot about a transverse axis through the bushing. The front end portion of the leaf spring is rounded about the transverse axis through the bushing and provides a bearing surface of high strength for receiving the hook device 38 of this invention during use. The opposite end of the hook device 38 is attached to a chain or cable 46 which is affixed at its free end to a tie-down device 48 at the rear of the automobile.

Figure 4:
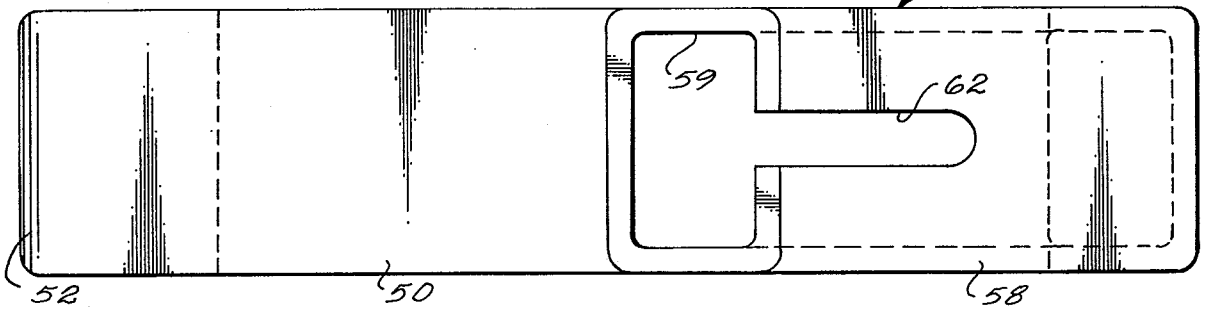
FIG. 4 is a bottom plan elevation view taken on line 4—4 of FIG. 2.
Figures 2, 3:
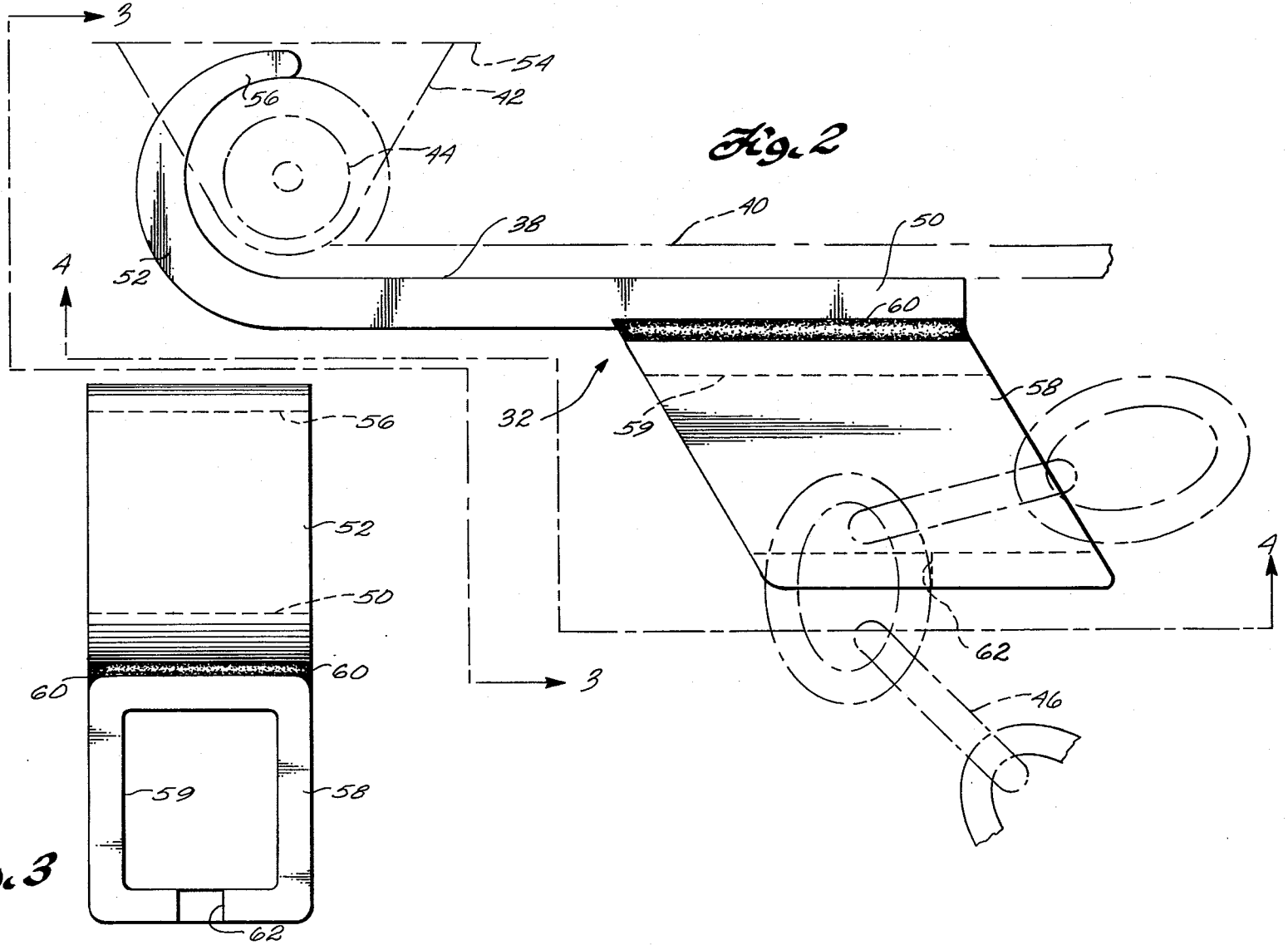
FIG. 2 is a fragmentary enlarged side elevation view showing the apparatus within the circle 2 of FIG. 1.
FIG. 3 is an end elevation view taken on line 3—3 of FIG. 2.

Referring to FIGS. 2 through 4, the hook device 38 includes an elongated metal bar of generally rectangular cross-sectional configuration. The lengthwise extent of the bar has a long straight section 50 which is bent at one end to form a C-shaped hook 52 having a generally circularly curved inside bearing surface for being releasably engaged with the bearing surface of the leaf spring assembly described above. The metal bar is preferably made from a piece of alloy steel initially about ⅜ to ½ inch thick. I have found that an alloy steel bar less than about ⅜ inch thick does not have the necessary strength to withstand the pulling forces of the level necessary to straighten automobile bodies of unitized construction. A bar greater than about ½ inch thick will of course be sufficient structurally, but may not meet the narrow clearance limitations in fitting the C-shaped hook 52 into the space between the underside of the automobile body (illustrated at 54 in FIG. 2) and the top edge of the leaf spring at its point of attachment to the front bushing.

The initially straight alloy steel bar is either drawn or forged at one end (the end to be formed as a hook) to form a tapered end portion 56 for ultimately fitting the hook 52 into the limited clearance space above the leaf spring's point of attachment to the body. Preferably, the end of the bar is forged by initially heating it and then impacting the end of the bar with a forging hammer which tapers the thickness of the bar to about ¼ inch at the forged end of the bar.

The metal bar is then heated in a furnace and the forged end portion is bent while hot to form the hooked end portion 52. Preferably, the bending is done by placing the forged end of the flat bar across a rounded opening of a fixed female die (not shown) in a forging press and forcing a hydraulically operated rounded male die (not shown) against the steel bar to push it into the rounded opening of the female die and thereby bend the metal bar to conform to the rounded shape of the dies. A plurality of die shapes and sizes are used to match the size and curvature of the inside surface of the hook to that of the leaf spring attachment assembly for each automobile to be straightened.

A means for releasably attaching the chain 46 to the hook device 32 is provided by a piece of metal tubing 58 having a square opening 59 extending through it from end-to-end. The square tubing 58 is rigidly attached to the straight section 50 of the hook device on a side thereof remote from the hook 52. The tubing 58 preferably is made from ¼ inch to ⅜ inch alloy steel and is attached to the flat portion of the hook by welding 60. The ends of the square tubing 58 are angled downwardly away from the straight portion of the hook, preferably by saw cutting, although this step is not critical, and more vertically straight end surfaces can be used. A narrow elongated slot 62 is formed centrally in the wall of the square tubing 58 spaced furthermost from the hook 52 in the portion of the tubing which faces toward the hook 52. Hence, the slot 62 opens outwardly toward the hook end 52. The slot 62 is punched out by a die in a punch press.

The finished hook and tube is then subjected to heat treatment, preferably by heating it in an oven, quenching it in water, heated again, and immersed in oil. The heat treatment makes the hook relatively springy to avoid brittleness so that the hook can withstand up to 10 tons of force at the machine end without failing.

The slot 62 provides a means for releasably holding the end of the chain 46 in the opening through the square tubing, as illustrated best in FIG. 2. Preferably, the chain used in a ⅜ inch alloy steel chain, and the width of the slot 62 is sufficiently oversized to just allow the width of a chain link to pass through it. The width of the chain link above the link in the slot 62 bears against the flat inside surface of the tubing above the slot to releasably hold the chain in the tubing against a pulling force applied to the left on the automobile body shown in FIG. 1.

Figure 5:
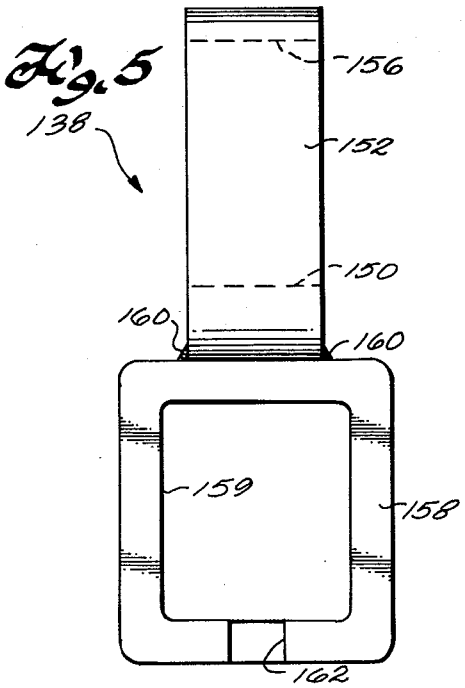
FIG. 5 is an end elevation view showing an alternate form of the anchor device of this invention.

The width of the hook 52 varies depending upon the clearance width at the rounded front end portion of the leaf spring at its point of attachment to the automobile body. The hooks may range in size from 1 to 2½ inches in width to fit nearly all sizes of automobile suspension spring assemblies. The hook shown in FIGS. 2 through 4 has a generally maximum width for one type of leaf spring attachment. FIG. 5 shows an alternate hook 138 which is narrower in width and is used for clearance purposes in the leaf spring suspension of a different make of automobile.

Figure 6:
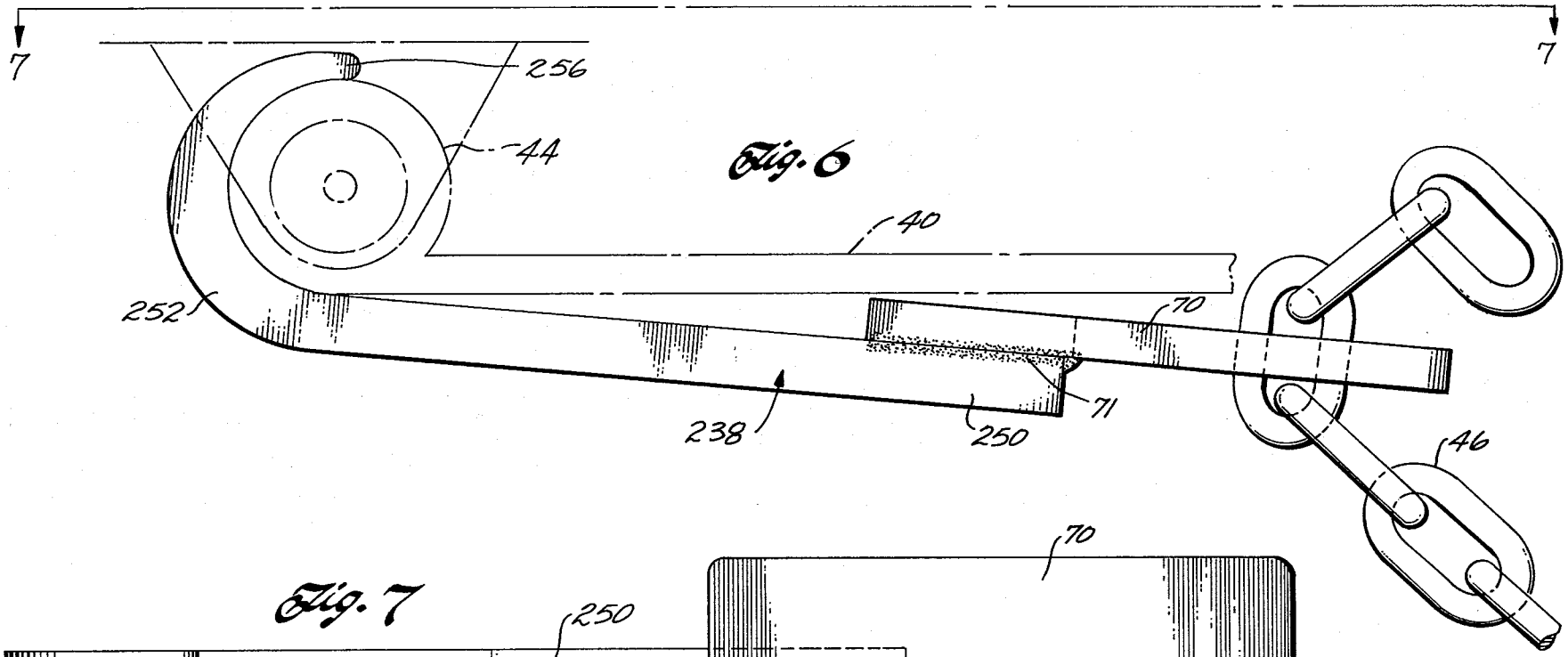
FIG. 6 is a fragmentary side elevation view showing an alternate form of the anchor device according to this invention.
Figure 7:
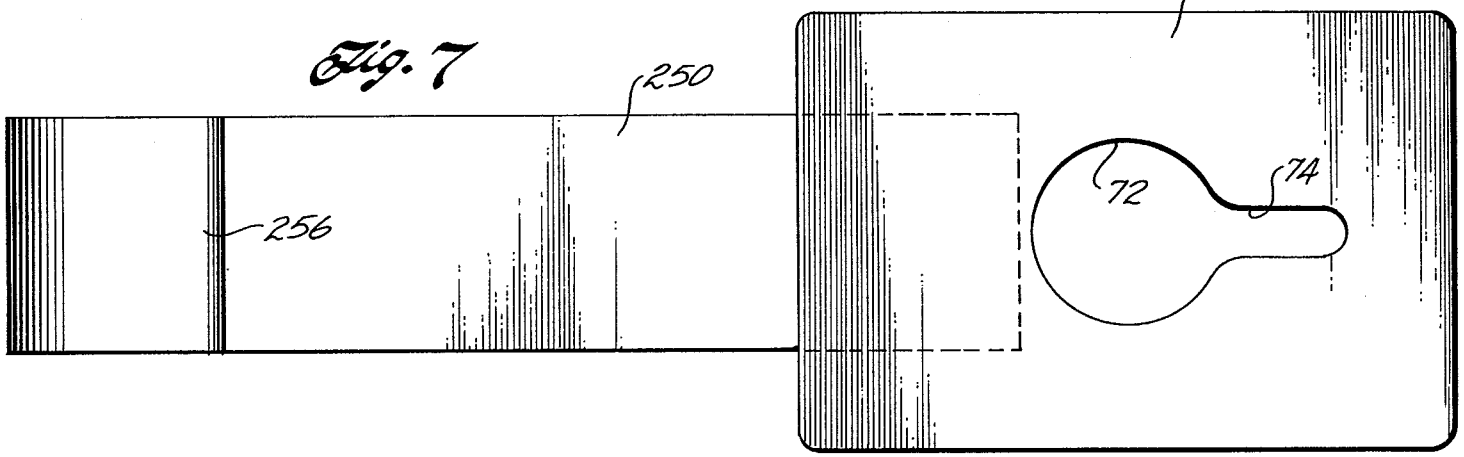
FIG. 7 is a top plan view taken on line 7—7 of FIG. 6.

FIGS. 6 and 7 show an alternate hook device 238 which can be used for the same applications as the hooks 38 and 138 described above. I have learned that when a pulling force is applied by the hooks 38 and 138 as illustrated in FIGS. 1 and 2, that the straight section 50 of the bar 38 can apply an upward force to the leaf spring 40 or other portions of the automobile suspension system. The end 50 of the bar may lift up sufficiently to apply force to the leaf spring when the anchor chain 46 is fixed to the hook device at the point below the end portion of the bar as illustrated best in FIG. 2. The form of the hook device 238 overcomes this problem by replacing the tubing 58 with a narrow, flat plate 70 which is rigidly secured to the straight end portion 250 of the bar 238 by welding 71. Preferably, the plate 70 is made from a piece of ⅜ inch thick hot rolled steel. The plate is preferably about 5 inches long and about 3 inches wide and is welded to the top surface of the hook 238 as shown best in FIG. 6. The plate extends lengthwise away from the end portion of the bar remote from the hook end 252, and the portion of the plate which projects away from the hook device includes an enlarged generally central opening 72 which narrows down to a narrow slotted opening 74 extending further away from the hooked portion of the bar 238.

In using the hook device 238, the chain 46 is inserted in the opening 72 of the plate 70. The width of the slot 74 is sufficiently oversized to just allow the width of a chain link to pass through it. The chain link above the link fitted in the slot 74 then bears against the top surface of the plate 70 to releasably hold the chain and the plate against a pulling force applied against the anchor provided by the hook device 238. During use, when a pulling force is applied to the hook device 238, the straight portion 250 of the hook angles downwardly away from the leaf spring 40 so as to avoid applying any pressure to the leaf spring or any other parts of the automobile suspension system.

The hook 238 also may be used as an anchor to a rear means of attaching the rear leaf spring to an automobile. For example, there are many instances in which it is necessary to apply a longitudinal pulling force to a frame rail to remove a kink from a portion of the rail which projects upwardly from above the rear leaf spring. The hook 238 can be used to provide an anchor point on the transverse bushing in the bracket for attaching the rear end of the rear leaf spring to the automobile frame. Anchoring the chain to this portion of the automobile can be difficult because of the lack of clearance which is typically available, but the narrow profile of the hook 238 and the plate 70 allows the anchor device to be hooked around the bushing and then used as an effective pulling point for straightening out the kink in the frame rail.

Figure 8:
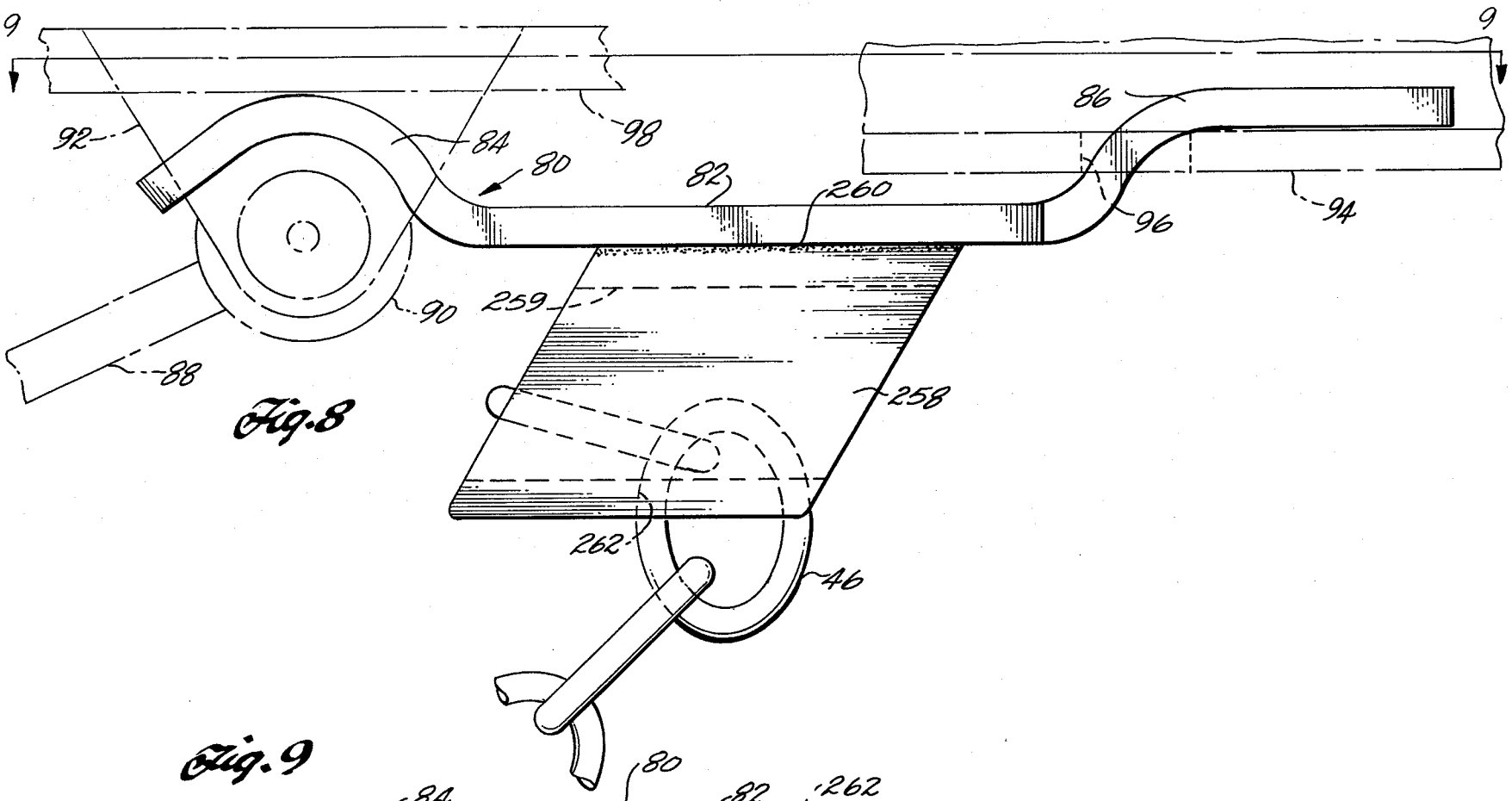
FIG. 8 is a fragmentary side elevation view showing a further alternate form of the anchor device of this invention.
Figure 9:
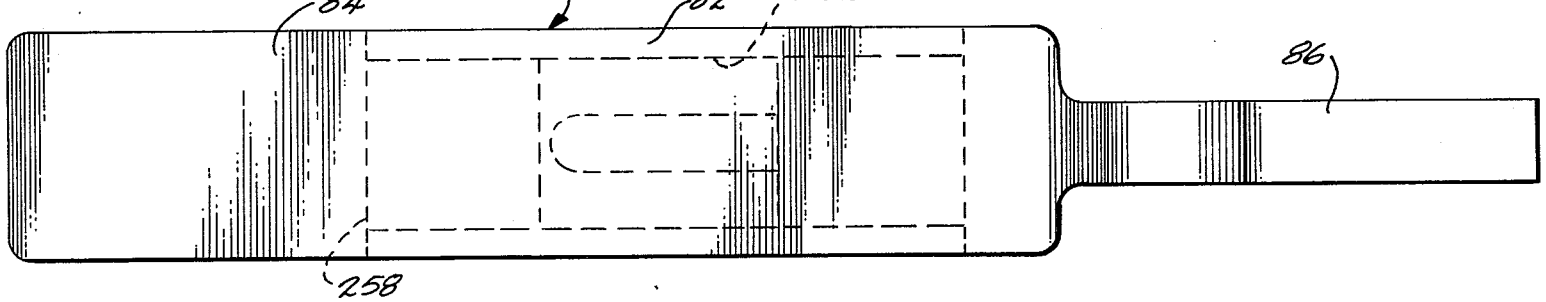
FIG. 9 is a top plan view taken on line 9—9 of FIG. 8.

FIGS. 8 and 9 show a further form of the invention in which an anchor device 80 includes an elongated metal bar having a long straight central portion 82, a first end portion 84 which is curved upwardly from the plane of the central portion 82 and extends lengthwise away from the central portion, and a second end portion 86 which is also curved upwardly away from the plane of the central portion 82 and also extends lengthwise away from the central portion 82. The metal bar 80 is made substantially the same way as that of bars 38, 138, and 238 in that it comprises a piece of alloy steel initially about ⅜ to ½ inch thick which is forged and heat treated.

A means for releasably attaching the chain 46 to to the anchor device 80 is provided by a piece of square metal tubing 258 identical in configuration to tubing 58 described above. The tubing is rigidly attached to the bottom surface of the straight portion 82 of the bar by welding 260. The tubing includes a narrow slotted opening 262 in a wall of the tubing spaced remotely from the bar 80. The opening through the tubing 258 and the slotted opening 262 provides a means for frictionally holding the chain 46 against a pulling force applied to the right in FIG. 8.

FIG. 8 illustrates a preferred use of the anchor device 80 in an automobile having a suspension system which includes a rear control arm 88 attached to a transverse strut arm 90, bushing, or the like extending between a bracket 92 projecting below a frame member 94. An opening 96 typically is located in a bottom portion of the automobile frame forward of the control arm point of attachment to the bracket 92. This type of suspension system arrangement often is so weak that an anchor point on the bushing 90 cannot be used when applying pulling forces of the magnitude necessary for straightening an automobile body. The anchor device 80 provides an anchor point at this portion of the suspension system without applying a force to the bushing or control arm which would damage the suspension system. As shown best in FIG. 9, the second portion 86 of the anchor device is necked down sufficiently so that it will fit through the opening 96 and the frame 94. The first end portion 84 of the anchor device releasably engages the rounded portion of the bushing 90. When a pulling force is applied to the automobile against the anchor provided by the anchor device 80, the second end portion 86 of the anchor forces down on the frame 94, and the first end portion 84 of the anchor device presses up against the portion 98 of the frame located above it. This reduces the amount of force applied to the bushing, control arm, or other parts of the rear suspension system while still providing an effective anchor point for a pulling force applied to the right in FIG. 8.

Thus, the invention provides a structurally sound anchor point or pulling point when straightening automobile bodies of unitized construction. The device avoids marring the body of the automobile itself, and can save the body repairman and the customer substantial amounts of time and money. Moreover, the anchor device is relatively simple and inexpensive to manufacture in different sizes and shpaes for different automobiles, and is easy and reliable to use.

I claim:

1. A method for straightening an automobile body wherein a pulling force required to straighten the automobile is applied to the automobile and an anchoring device anchors the automobile body against the pulling force, the automobile body being of unitized construction and having a longitudinal axis and a suspension spring assembly which includes a longitudinally extending, elongated rear leaf spring having a front end and a rear end, a bracket extending downward from the automobile body, and means attaching the front end of the leaf spring to the bracket, the spring attaching means being rounded about an axis transverse to said longitudinal axis of the body, the method including the steps of releasably attaching an anchoring device around the rounded portion of the leaf spring attaching means wherein the anchor device includes a hook made from an elongated steel bar of generally rectangular cross-sectional configuration being between about ⅜ inch to about ½ inch in thickness and being between about 1 inch and about 2½ inches in width, one end portion of said rectangular bar being curved to form a generally C-shaped hook having a generally circularly curved inside bearing surface for being releasably attached to the rounded portion of said leaf spring attaching means, the bar having a portion thereof extending away from the hook to form an elongated, relatively straightened end portion remote from the hook; extending said straightened portion of the bar toward the rear end of the leaf spring when the hook portion of the bar is releasably engaged with said rounded portion of the leaf spring attaching means; attaching one end of a tension line means to a point of attachment on the straightened portion of the bar and securing an opposite end of the tension line means to the ground; and applying a pulling force to the automobile via a force means to straighten the automobile body.

2. The method according to claim 1 including anchoring the free end of the tension line to the ground to the rear of the point of attachment of the leaf spring, and pulling on the front end of the automobile in a direction away from the anchor to the rear leaf spring.

3. The method according to claim 1 in which the means for attaching the chain to the hook includes a steel plate secured to the straightened portion of the bar and having an opening extending therethrough for receiving an end of the tension line; and including the step of disposing an end portion of the tensin line through the opening in the plate to frictionally hold the chain in said opening.

4. The method according to claim 1 in which the means for attaching the chain to the hook includes an elongated piece of steel tubing rigidly attached to said straightened portion of the bar on a surface thereof facing away from the C-shaped hook, the tubing having an opening extending axially therethrough and a narrow slot formed in a wall of the tubing spaced from the remote straightened end portion of the bar; and including the step of extending a tension line through the axial opening in the tubing and frictionally engaging the tension line with the narrow slot in the tubing, anchoring the free end of the tension line to the ground away from the tension line's engagement with the narrow slotted opening, and pulling on the front of the automobile in a direction away from the anchor provided by said tubing.

* * * * *